US010472873B2

(12) United States Patent
Ladha et al.

(10) Patent No.: US 10,472,873 B2
(45) Date of Patent: Nov. 12, 2019

(54) SENSOR BASED DOOR CLOSER WITH AN INTELLIGENT CONTROL SYSTEM

(71) Applicants: Riaz Ladha, Markham (CA); Faisal Ladha, Markham (CA)

(72) Inventors: Riaz Ladha, Markham (CA); Faisal Ladha, Markham (CA)

( * ) Notice: Subject to any disclaimer, the term of this patent is extended or adjusted under 35 U.S.C. 154(b) by 205 days.

(21) Appl. No.: 15/629,821

(22) Filed: Jun. 22, 2017

(65) Prior Publication Data

US 2018/0371818 A1 Dec. 27, 2018

(51) Int. Cl.

| | |
|---|---|
| ***E05F 15/42*** | (2015.01) |
| ***E05F 3/10*** | (2006.01) |
| *E05F 15/73* | (2015.01) |

(52) U.S. Cl.

CPC ..... *E05F 15/42* (2015.01); *E05F 3/102* (2013.01); *E05F 15/73* (2015.01)

(58) Field of Classification Search

CPC . E05F 15/40; E05F 15/42; E05F 15/73; E05F 3/22; E05F 3/102; E05Y 2900/132; E05Y 2400/53; E05Y 2400/302; E05Y 2201/462; E05Y 2201/21; E05Y 2400/532

See application file for complete search history.

(56) References Cited

U.S. PATENT DOCUMENTS

| | | | | |
|---|---|---|---|---|
| 4,967,083 | A * | 10/1990 | Kornbrekke | G01S 17/026 250/221 |
| 8,225,458 | B1 * | 7/2012 | Hoffberg | E05F 3/102 16/49 |
| 8,359,790 | B2 * | 1/2013 | Shin | E05F 5/00 49/26 |
| 8,415,902 | B2 * | 4/2013 | Burris | E05F 3/102 16/52 |
| 9,869,117 | B2 * | 1/2018 | Houser | E05F 15/611 |
| 9,995,076 | B1 * | 6/2018 | Hoffberg | E05F 3/102 |
| 2012/0029701 | A1 * | 2/2012 | Houser | E05F 15/70 700/275 |

* cited by examiner

*Primary Examiner* — Katherine W Mitchell
*Assistant Examiner* — Abe Massad
(74) *Attorney, Agent, or Firm* — Nasser Ashgriz; UIPatent Inc.

(57) ABSTRACT

The present invention provides a door closer control system that includes a door closer having a rack and pinion mechanism connected to a pair of shafts with different length and a pair of springs. The shorter shaft is attached to the pinion of the door closer and will rotate in conjunction with the pinion as the door opens or closes. The shafts have correspondent gears connected to the shafts. The rotation of the first gear will be meshing with the second gear on the second shaft. Electronic sensors are placed on both sides of the door to detect a presence of an object and are activated by the movement of the solenoids. The movement of the solenoids cause a set of springs in the system to engage and disengage from a link to allow free motion of the door.

11 Claims, 10 Drawing Sheets

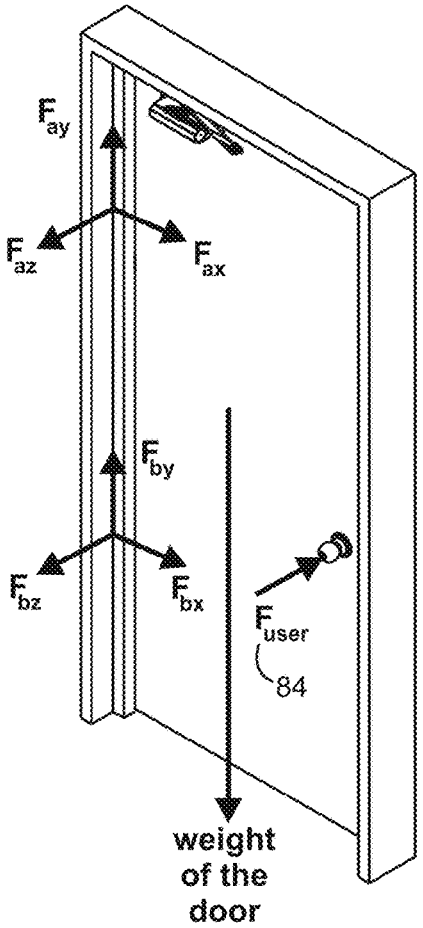
FIG. 7A
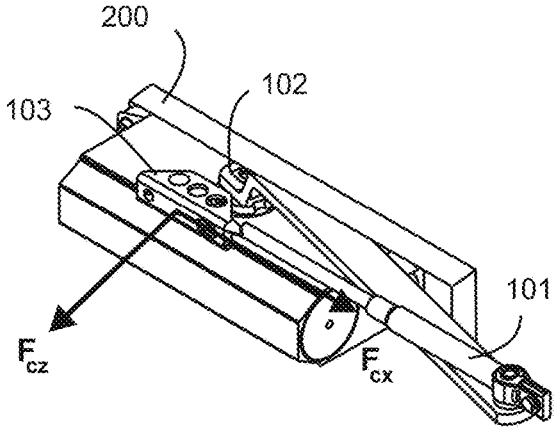
FIG. 7B
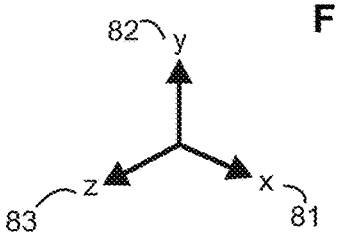

SENSOR BASED DOOR CLOSER WITH AN INTELLIGENT CONTROL SYSTEM

FIELD OF THE INVENTION

The present invention relates in general to the field of automatic door closing devices, and in particular to a door closer system for dampening the motion of a door.

BACKGROUND OF THE INVENTION

Door closers are used to automatically close doors; hold doors open for short intervals, and control opening/closing speeds of a door in order to facilitate passage through a doorway and to help ensure that doors are not inadvertently left open. A door closer is often attached to the top or the bottom of a door. When the door is opened and released, the door closer generates a mechanical force that causes the door to automatically close without any user input.

When people are in the process of entering or exiting a door, they may swing the door, which may hit persons on the opposite side of the door. This is especially noticeable around restrooms where opaque doors are necessary. In such situations, for example, person-A exiting may be in a tight quarter, and person-B entering may be in a hurry, pushing the door into person-A, causing possible harm. The probability of this accident increases in high traffic hallways or stairwells. Another use for this door device is to prevent the door from being blown open and out of control on a windy day.

According to the American Society of Safety Engineers, in 2009 alone, there were 120 accidents that required amputations, 410 accidents that caused multiple traumatic injuries and disorders, and 870 injuries that caused pain and soreness. All of these accidents happened because people did not know if there is another person on the other side of the door. The present invention is designed to prevent such accidents.

SUMMARY OF THE INVENTION

The present invention aims to reduce the number of injuries associated with a quick opening of a door. This invention relies on the fact that springs can dampen motion and that this dampening force increases as the springs' extension increases. This design further allows a cushioned stopping force for anyone who may be approaching the door in high speed. Furthermore, the design is an add-on upgrade to existing door closers, which reduces the hurdle of replacing or revamping the existing door closers.

The present invention provides a door closer control system that includes a door closer having a rack and pinion mechanism connected to a pair of shafts and a pair of springs. The shafts are mounted parallel to each other and have different lengths. The shorter shaft is attached to the pinion of the door closer and rotates in conjunction with the pinion as the door opens or closes. The longer shaft is located at a predefined distance from the shorter shaft.

The two shafts are coupled through a pair of gears (one on each shaft). The rotation of the first gear on the shorter shaft will mesh with the second gear on the longer shaft, rotating the longer shaft.

A pair of springs is connected to a link. The springs engage and disengage from the link to allow free motion of the door. This engagement and disengagement will be achieved using solenoids that will be in their extended position. The present invention is equipped with a pair of passive infrared (PIR) sensors to detect the presence and/or absence of an object in an area around or on both sides of the door. The sensors activate the solenoids which are mounted underneath the springs. When the electronic sensors detect a potential for injury, the solenoids will retract allowing the springs to engage with the link. As the door opens, the springs engage to the link and extend due to the rotation of the link. The restoring force of the springs will take effect due to the extension in the springs.

An alert system can achieve by a chime or a light to convey this information. A sensor that can detect wind speed could also be connected to ensure the door is not blown from the user's control.

It is an object of the present invention to prevent potential damage to all entities within close proximity to the door.

It is another object of the present invention to halt and/or alter the motion of the door and alert the involved parties of its operation.

It is another object of the present invention to be easy to maintain and can be mounted on any door closer.

It is another object of the present invention that all components of the design should be standardized for easy replacement.

It is another object of the present invention to have softer dampening effect.

It is another object of the present invention to avoid abrupt stoppages to motion.

It is another object of the present invention to abide to all fire code regulations imposed by the fire protection and prevention.

It is another object of the present invention to reduce liability risks by reducing of damage to door systems and possibly save on heating costs.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

FIG. 7A shows a perspective view of a door with a door closer and the forces acting on the door;

FIG. 7B shows a perspective view of a door closer and the forces acting on the door closer;

DETAILED DESCRIPTION OF PREFERRED EMBODIMENTS

The device disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

Figure 1A:
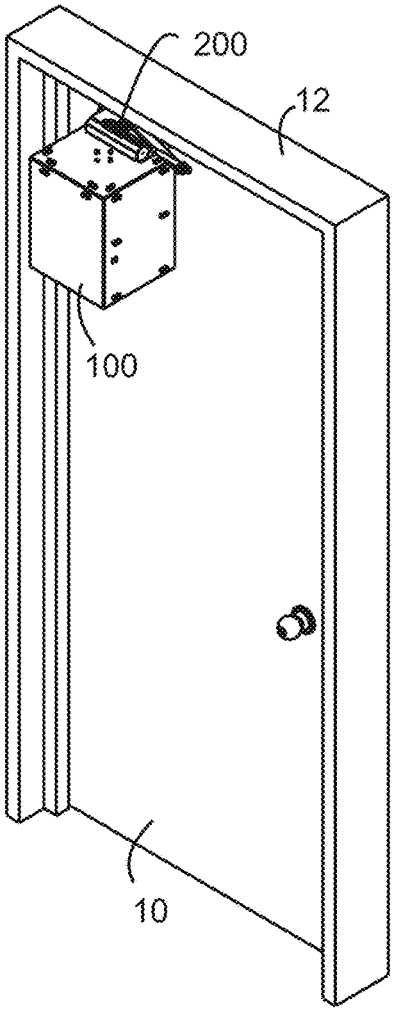
FIG. 1A shows a perspective view of the present invention installed at the top part of a door.
Figure 1B:
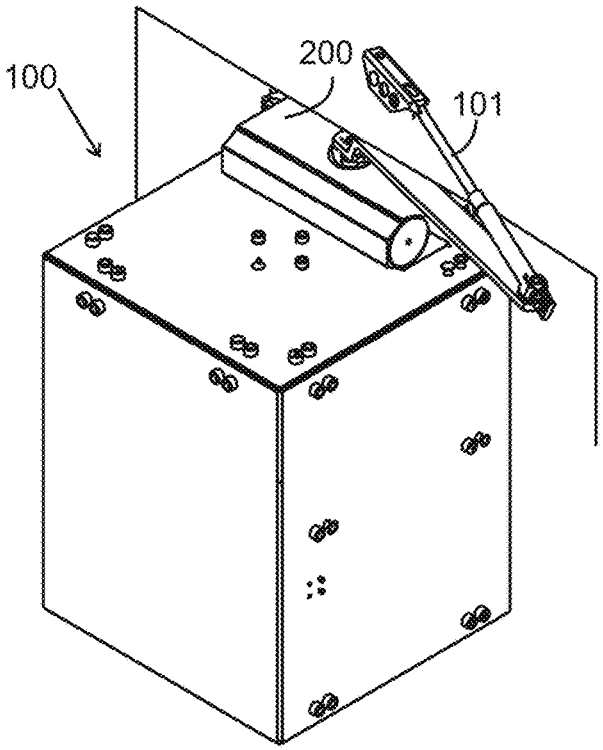
FIG. 1B shows an enlarged perspective view of the present invention installed at the top part of a door.
Figure 2A:
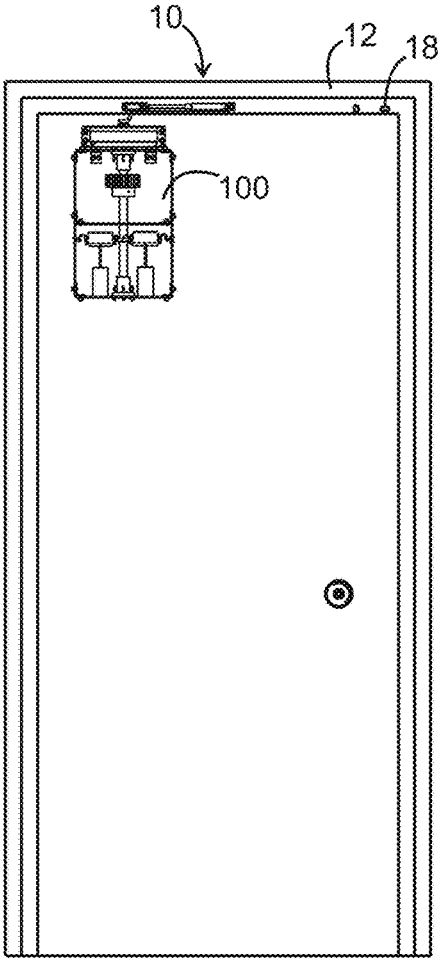
FIG. 2A shows a front view of the present invention installed at the top part of a door.
Figure 2B:
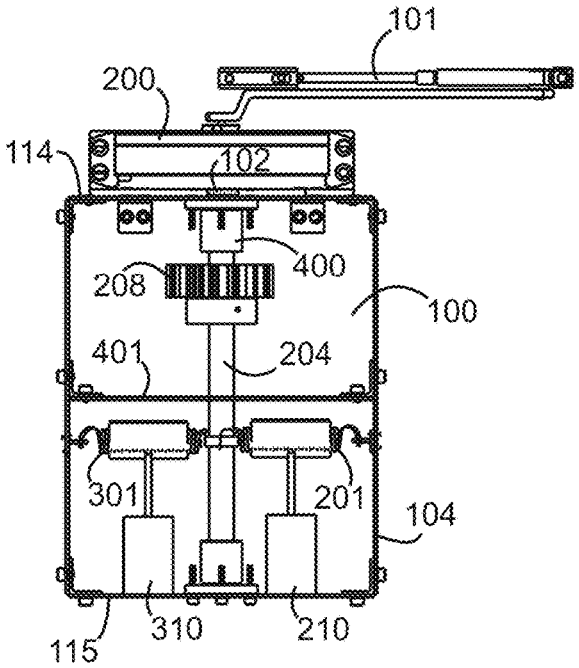
FIG. 2B shows a front view of the present invention.
Figure 3:
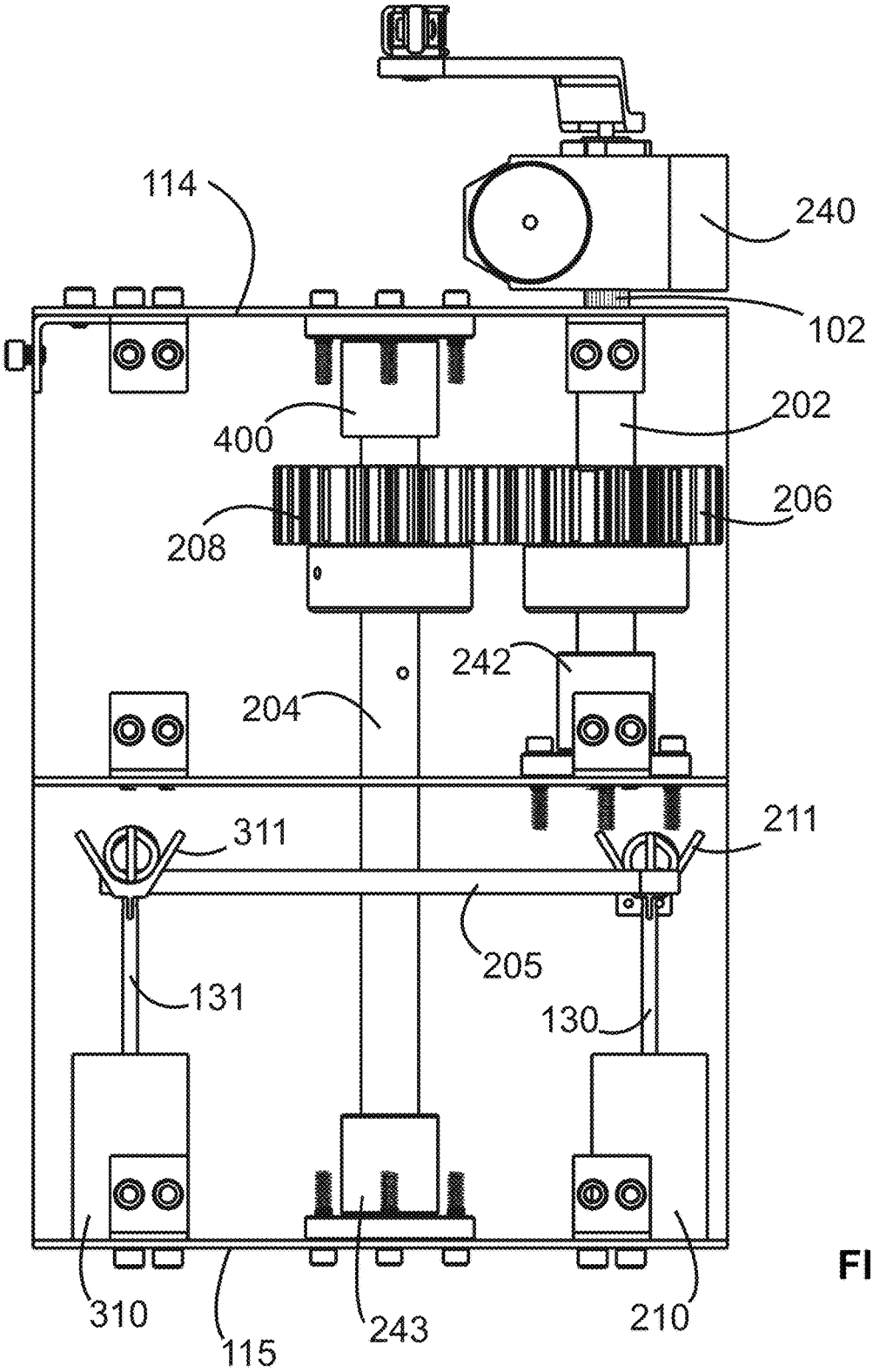
FIG. 3 shows a side view of the present invention.
Figure 4:
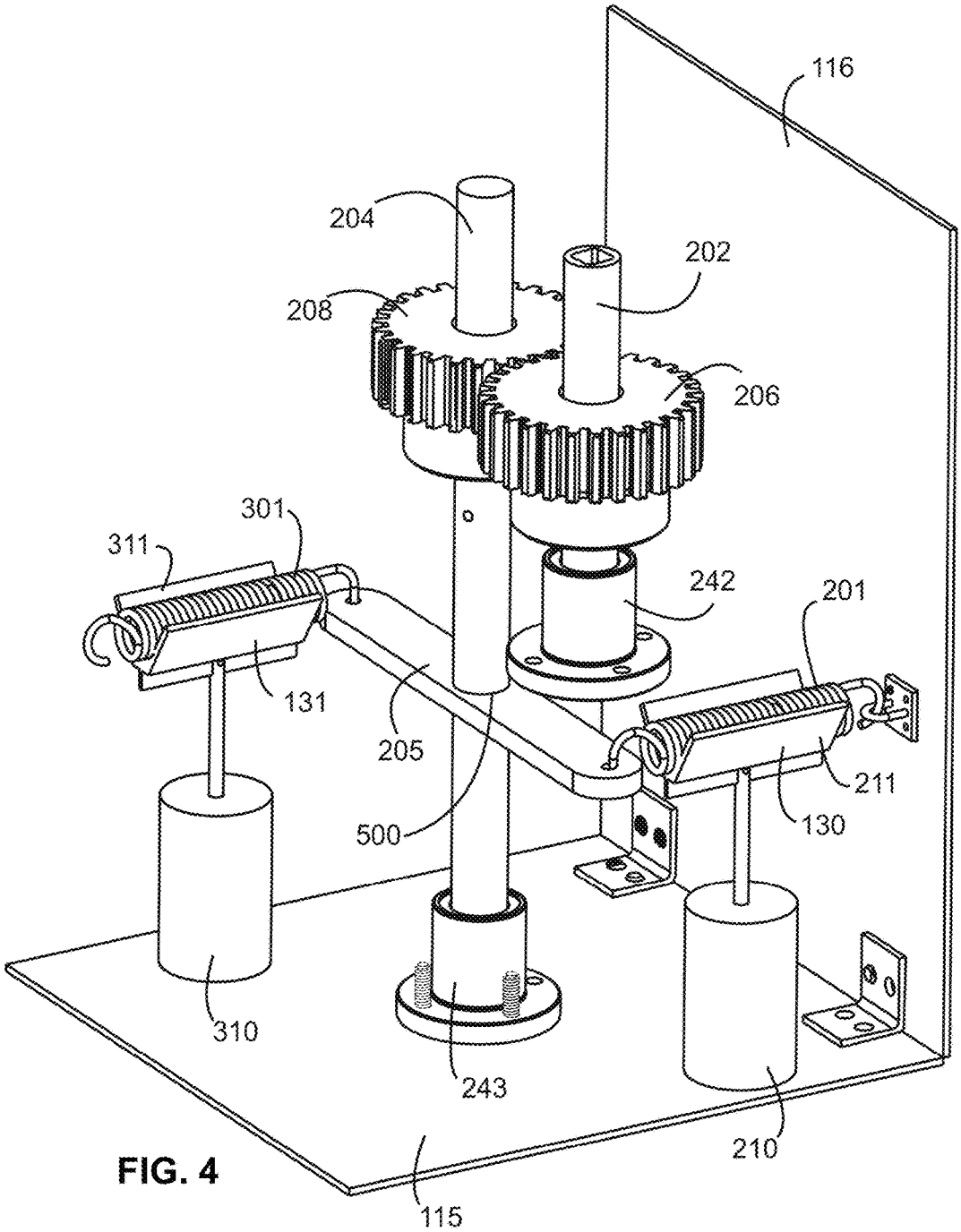
FIG. 4 shows a perspective view of the main parts of the present invention.

As shown in FIG. 1, the present invention is a control system 100 that can be added to an existing door closer 200 to prevent a rapid opening and closing of a door 10 by a person when another person may be on the other side of the door 10. A door closer 200 is typically found on the top of many doors and can be easily installed.

A typical door closer is designed to translate the push force by the user on the door to a pinion gear in the door closer. As the door is opened, the pinion gear starts to rotate, which moves the piston of the door closer horizontally. A spring that is attached to the piston is compressed during this opening motion. Then, the spring exerts a force on the piston, and the amount of force depends on the degree of compression. When the door is released, the stored energy in the spring pushes the piston back.

The preferred embodiment of the present invention 100 is illustrated in FIGS. 1A, 1B, 2A, 2B, 3, 4 and 5. The present invention 100 is mounted on a door 10 and attaches to the pinion gear 102 of an existing door closer 200. The door 10 is movable relative to a frame 12 between a closed position and an open position. The door closer 200 includes a linkage assembly 101 for operably coupling the control system 100 to the doorframe 12. It should be understood that the linkage assembly 101 for use in the present invention might be in any arrangement capable of linking the door closer 200 to the door 10 in such a manner that the door closer 200 affects movement of the door 10.

The control system 100 of the present invention is securely mounted to the upper edge of the door 10. Any securing or fastener means, such as screws or adhesive strap can be used to secure the control system 100 on the door 10. The control system 100 comprises of a housing 104 to enclose all its components. The housing 104 comprises of a top plate 114, a bottom plate 115, a right side plate 116, a left side plate 117 and a front plate 118. It is understood that the housing 104 can have any shape and size, as long as it can accommodate all the components of the system.

According to FIGS. 2A, 2B, 3, 4 and 5, the present invention 100 comprises of a pair of spaced apart parallel shafts 202, 204; a short shaft 202, and a long shaft 204, which are rotatably engaged in the housing 104. Each shaft 202, 204 have a corresponding gear 206, 208 respectively coupled to each other. A dividing plate 401 is provided in the housing 104 with an elevation from the bottom plate 115 to secure the short shaft 202. A bearing 242 is used to hold the short shaft 202 on the dividing plate 401.

The long shaft 204 is vertically and rotatably attached on the bottom plate 115 of the housing 104. The rotation of the corresponding gear 206 on the short shaft 202 meshes with the second corresponding gear 208 on the long shaft 204. The long shaft 204 stands at a predefined distance from the short shaft 202 and extends from the top plate 114 to the bottom plate 115 of the housing 104. The long shaft 204 is rotatably secured from a distal end to the top plate 114 by a bearing 400. The shafts 204 and 206 rotate in conjunction with the pinion gear 102 as the door opens or closes. To create space for all the other mechanical components, the location of shafts 202, 204 and gears 206 and 208 is designed away from the door 10.

A horizontal link part 205 is attached to the long shaft 204. The long shaft 204 is preferably passed through a central aperture 500 of the link part 205 with a press fit connection. Thereby, the horizontal link part 205 rotates as the long shaft 204 rotates. The link part 205 further comprises of a right aperture 501 and a left aperture 502 to respectively receive one end of a right spring 201 and a left spring 301.

The right spring 201 and the left spring 301 are respectively attached to the right side plate 116 and the left side plate 117 of the housing 104. Thereby, both the clockwise and the counter clockwise rotation of the long shaft 204 are damped by the two springs 201 and 301. The springs 201, 301 constants are predetermined to prevent a rapid opening and closing of the door 10.

Figure 5:
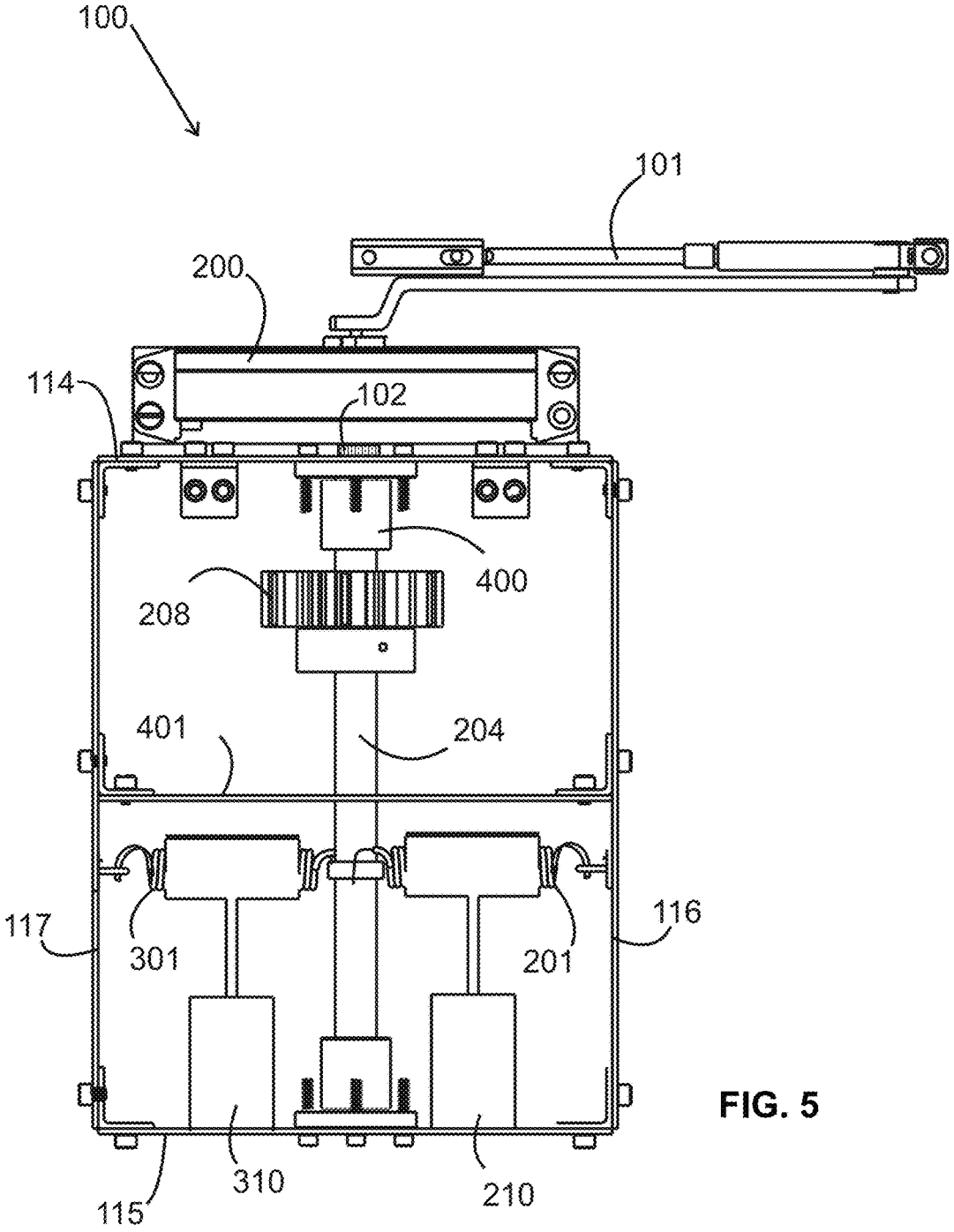
FIG. 5 shows a front view of the present invention.
Figure 6A:
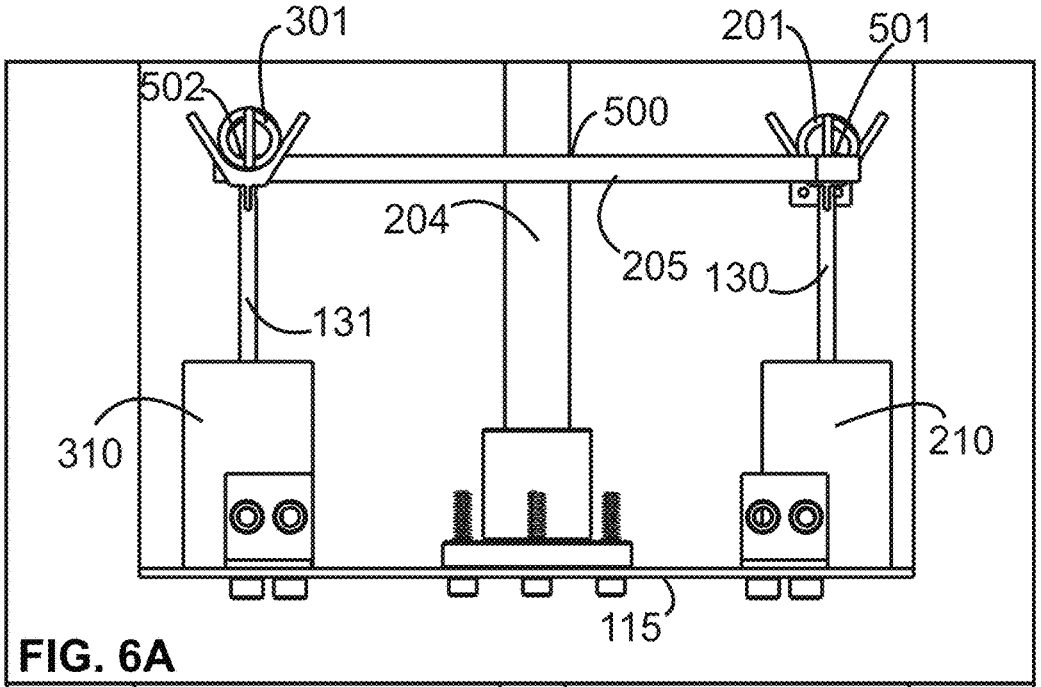
FIG. 6A is a side view of the present invention showing the link and springs in the normal working of the door.
Figure 6B:
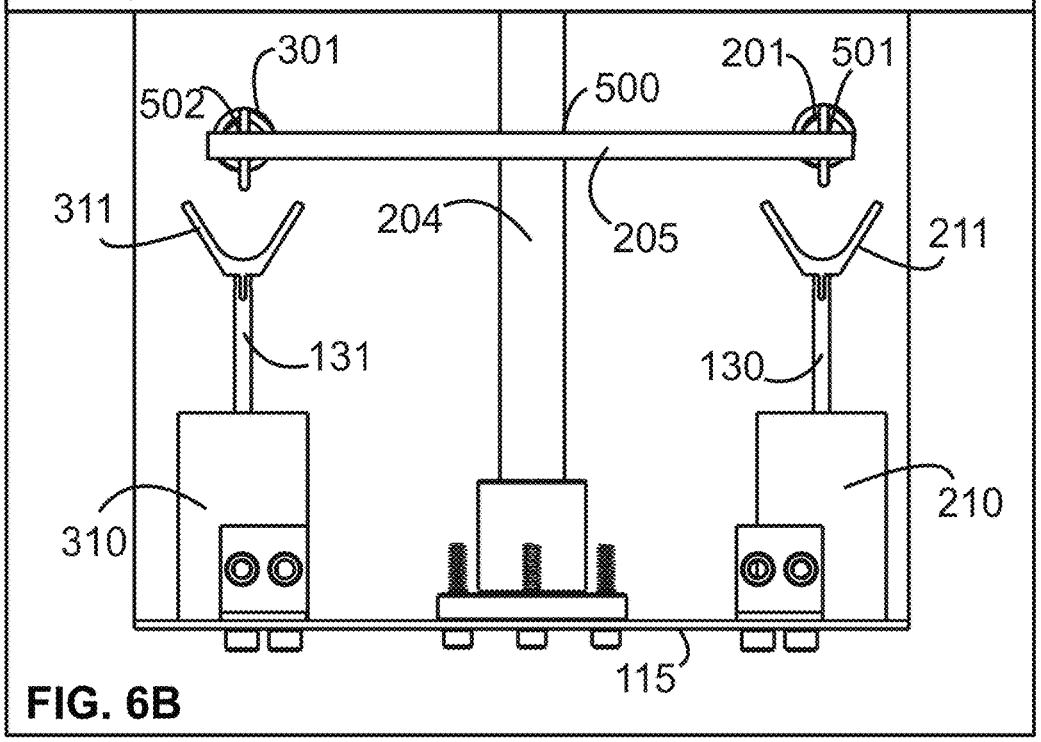
FIG. 6B is a side view of the present invention showing the link and springs in the restrict position of the door.

According to FIGS. 5, 6A and 6B, the present invention 100 involves using springs 201, 301 to dampen the motion of the door 10 when is being opened. The first spring 201 is connected from one end to the right side plate 116 of the housing 104 and from its opposite end is hooked onto the side aperture 501. The second spring 301 is connected from one end to the left side plate 117 of the housing 104 and is hooked onto the aperture 502. Depending on the direction of the door rotation, the shafts 202, 204 will rotate accordingly. As such, the springs 201, 301 must always be installed on the hooks that will produce the restoring force.

In a normal operation of the door 10, the springs 201, 301 are not engaged with the horizontal link part 205 and the long shaft 204, and the door 10 can open and close based on the setting on the door closer 200.

Two solenoids 210 and a 310 are used to engage and disengage the springs 201, 301 from the horizontal link part 205. Two solenoids 210, 310 are mounted on the bottom plate 115 of the housing 104. The solenoids 210, 310 are used to disengage the springs 201, 301 from the linkage. The right solenoid 210 is located under the right spring 201 and the left solenoid 310 is located under the left spring 301. In the normal operation of the door 10, the solenoids 210, 310 keep the springs 201, 301 in a lifted position and disengaged from the horizontal link part 205, thereby, the door 10 can be opened and closed rapidly. However, when the solenoids 210, 310 are activated, the solenoid shaft 130, 131 moves downward allowing the springs 201, 301 to move downward and engage with the horizontal link part 205.

At least two sensors, one on each side of the door 10, sense the existence of a person around the door 10 and activate the solenoids 210, 310. The sensors can be of any motion-sensing sensor such as infrared sensor.

The centre aperture 500 of the link part 205 is assumed to be at a fixed position relative to the long shaft 204. The springs 201,301 will always be disengaged from the link part 205 to allow free motion of the door 10. This disengagement will be achieved using solenoids 210 and 310 that will be in their extended position. When the electronic sensors detect a potential for injury, the solenoids 210 and 310 will retract allowing the hooks of the springs 201 and 301 to engage with the link part 205. As the door 10 opens with the springs 201 and 301 attached to the link part 205, the springs 201 and 301 will extend due to the rotation of the link part 205.

With increasing force, there will be an increasing torque opposing the motion of the link part 205 and causing it to return to its original position. The two shafts 202, 204 have different length to change the torque. The short shaft 202 is attached to a pinion 102.

According to FIG. 2, the PIR sensors 18 are placed on both sides of the door 10 to detect a presence and/or an absence of an object in an area around the door 10 on both sides. Sensors 18 are positioned at the top of the doorframe 12. A processor to process the information from the sensors 18, LED lights and the solenoids 210, 310 are placed on the housing 104. The PIR sensor 18 is able to provide adequate range for sensing objects. When one or more sensors 18 on both sides are triggered to signify the presence of entities on both sides of the door 10, the control system of the present invention 100 is activated.

According to FIGS. 6A and 6B in normal working of the door 10, when the door 10 is about to be opened, if the sensors 18 detect either stationary objects in their sensing range or detect moving objects on only one side of the door, they will keep the springs 201, 301 in the upright position. In the ordinary opening and closing of the door 10, the link part 205 and the springs 201, 301 are not in contact, and the solenoids 210 and 310 are in full-extended position. In the position to restrict the door 10 from opening the spring's ends 201, 301 are inside the link part 205 and the solenoids 210, 310 are pulled to the minimum position. A pair of V-shaped supports 211, 311 is provided on solenoids 210 and 310 to support the springs 201 and 301 in the restricted position however any kind of support means can be used to support the springs.

The solenoids 210, 310, the sensors 18, and the processor are powered by a set of rechargeable batteries. A generator may install inside the housing 104 to generate electricity by door motion to provide power for the electric part.

FIGS. 7A, 7B, 8A and 8B show the forces and the torques acting in the system, based on which, the proper sizes of different elements of the present device, and the spring constants are determined. The design calculations are disclosed in two methods. The first method (FIGS. 7A, 7B) shows the force diagram for static case. In order to find the exerted torque on the pinion shaft; the door closer pinion 102 is de-attached from the doorframe and appropriate reaction forces induced on the pinion 102 are shown. The net force acting on the door closer pinion 102 is divided into its x, y, and z (81, 82, 83) components. Since, the door closer pinion 102 is not supporting the weight of the door closer unit 200; the y component of the net force is equal to zero.

Figure 8A:
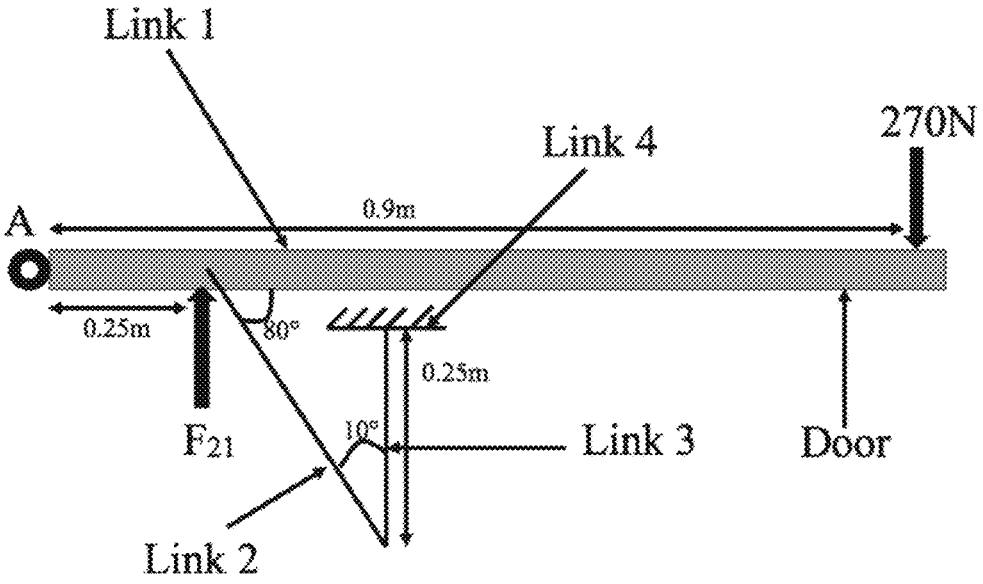
FIG. 8A shows a free body diagram of the whole setup of the present invention.
Figure 8B:
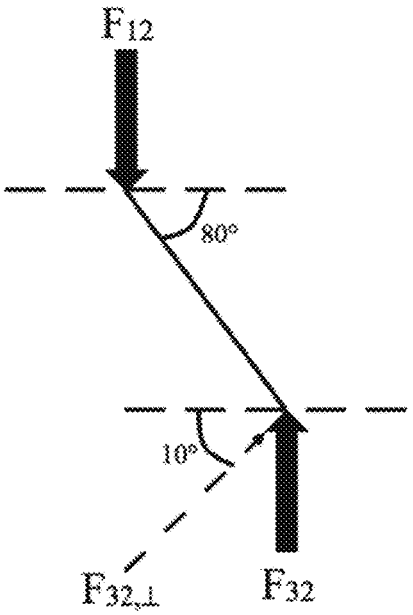
FIG. 8B shows a free body diagram of the forces provided on the link part of the present invention.
Figure 9A:
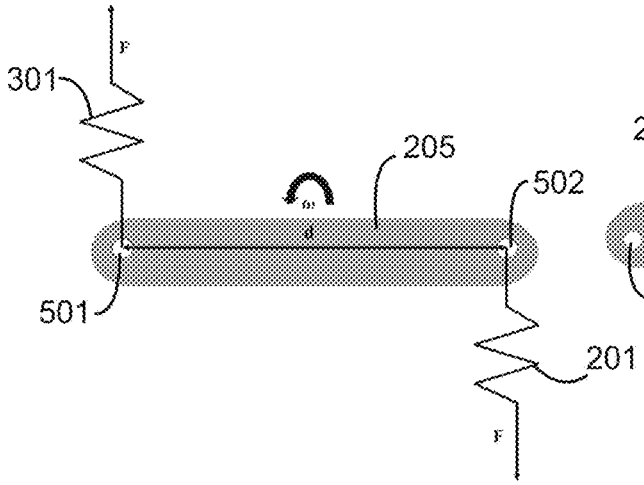
FIG. 9A shows the link part arrangement of the present invention.
Figure 9B:
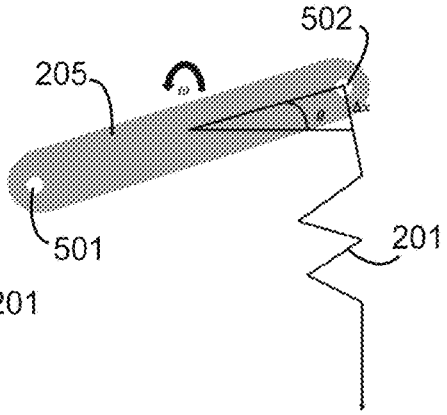
FIG. 9B shows the link part arrangement of the present invention.

According to FIG. 8B, the force F32 is the force from link 3 on 2 direction of which can be determined by visualizing the motion of link 2. However, this force does not produce the torque on the pinion. It is the perpendicular component of this force that produces the torque.

The link part 205 rotates in the counterclockwise direction, and then the springs 201 and 301 stretch creating a restoring force in them. As the door opens more, causing the link part 205 to rotate more, the restoration force in the springs 201 and 301 increases due to the increasing extension in the spring. When there is no rotation in the door, there is no extension in the spring and hence, no restoring force. Therefore, the restoring force starts from zero and continues to increase as the door continues to open creating a soft dampening effect.

The present invention further has a warning mechanism, which are installed at two different sides of the door to warn the user about the presence of an object on the opposite side of the door. The warning mechanism can be two warning lights installed at the top of the door at each side or two warning chimes installed at the top, middle or the bottom part of the door.

In one embodiment of the present device, the housing 104 is approximately 10 to 12 inches long and 9 to 12 inches wide. The top plate 114 and the bottom plate 115 are attached to the side plates 116 and 117 and front plate 118 by angle brackets. The short shaft 202 is 6 Inches in length and the long shaft 204 is 12 Inches in length. Based on the present design dimensions, the force applied at the two ends of the link 501 and 502 is about 231 N. The calculation of this force follows from the assumption that the maximum torque experienced by the shaft 204 is about 42.2 Nm. To counter this torque, the forces produced by the spring are about 231 N. The distance between the two springs 201 and 301 is 0.183 m.

In installation, the location of the door closer is adjusted to align and engage the pinion of the door closer with one end of the short shaft. For instance, a filler plate 240 is inserted on the locations behind the door closer 200 on the door 10 and the doorframe 12 to create more space for the gears within the housing and accommodate space for the movement of the various components of the present invention. The added filler plate 240 further increases the depth of the door closer system 100.

In another embodiment of the present device, an electric motor may be attached to the other end of the gears. The motor may be of any known variety, such as a DC motor, an electro magnet mechanism, hydraulics or pneumatics can also be used. Friction for dampening by using welded motor shaft can also be provided in the system to control the pinion gear of the dampening system. The motor may impede the closing of a door, such as by providing a brake or dampening force during opening and/or closing of the door. The system may also provide with energy storage components for power conditioning which may be, for example, a chargeable battery. The energy stored in the storage device may then be passed through power supply components and used for controllers and other components in the system.

Figure 10:
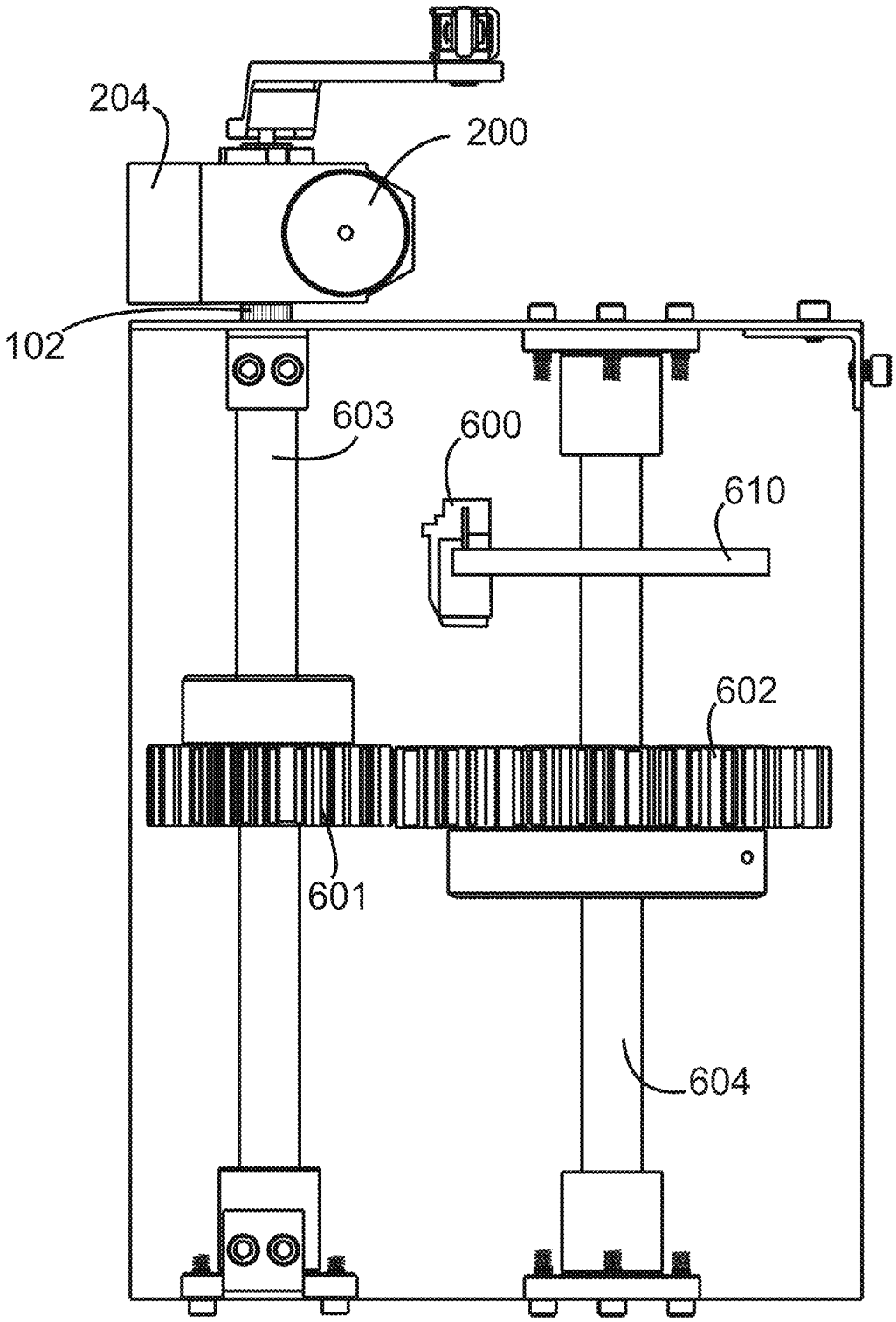
FIG. 10 is another embodiment of the present invention showing the disk-brake concept for door closer mechanism.

Another embodiment of the present invention is shown in FIG. 10. The disk brake 600 comprises of multiple components such as pistons, rotor disk, caliper, tubing, and springs. This design employs disk brake 600 to alter the motion of the door. The shaft 603 from the disk brake design mechanism will be attached to the pinion 102 of the door closer 200. The shaft 603, consequently, will rotate in conjunction with the pinion 102 as the door opens or closes. The rotation gears 601 and 602 are used to translate motion to a parallel axis of rotation that correlates with the opening and closing of the door. The parallel axis of rotation will be another shaft 604 with a gear 602 that will be meshing with a gear 601 on the first shaft 603. The second shaft 604 attached to a rotor disk 610. The disk brake 600 consists of a master cylinder that pushes brake fluid to another cylinder where the pistons push the brake pads and apply force on the disk.

In another embodiment, wires and pulleys may be used to dampen motion instead of springs in the design.

In another embodiment of the present invention, either sensor can also be equipped with a wind speed sensor to detect a windy condition near the door. Thereby, controlling the motion of the door in a windy condition.

The material for all of the parts of the present invention can be of any kind of material, such as AISI 1040 steel. The springs are also made from sturdy material, such as music-wire steel or AISI 1080 steel.

This invention can also be applied on the door of a vehicle. In this case, a sensor based system for doors in a vehicle is attached on a vehicle body. The sensors detect a presence and/or an absence of an object in an area around the vehicle, and control the door motion. Any object approaching the vehicle can trigger the sensors. Each door is equipped with the door closer control system to control and resist an opening motion. The location of the sensors can vary depending on the type of the vehicle and the configuration of the doors. They can be installed in the body of the vehicle near the doors or within the doors themselves. The present door control system can be installed in various places on the door body.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A door closer control system configured to attach to a door closer having a rack and a pinion mechanism, the door closer control system comprising a. a housing comprising of a top plate, a bottom plate, a front plate, a right side plate, a left side plate and a horizontal central plate;

b. a first shaft having a first shaft top and a first shaft bottom, connected to said pinion mechanism of said door closer from the first shaft top and secured to said horizontal central plate from said first shaft bottom;

c. a second shaft having a second shaft top and a second shaft bottom, rotatably secured to said top plate from the second shaft top and to said bottom plate from the second shaft bottom;

d. a first gear attached to said first shaft, and a second gear attached to said second shaft, wherein said first gear and said second gear are engaged to transfer a rotation of the first shaft to the second shaft;

e. a horizontal support link having a distal end and a proximal end, said link have a first aperture on its distal end and a second aperture on its proximal end, said link further having a central aperture;

f. a first spring having a first end and a second end, wherein said first end of said first spring is secured to said right side of said plate and said second end of said first spring is configured to engage to and disengage from said first aperture of said support link;

g. a second spring having a first end and a second end, wherein said first end is secured to said left side plate and said second end of said second spring is configured to engage to and disengage from said second aperture of said support link;

h. a first solenoid moveably mounted on said bottom plate beneath said first spring;

i. a second solenoid moveably mounted on said bottom plate beneath said second spring;

j. a set of sensors mounted on both sides of said door configured to detect a presence of an object in an area around the door;

k. a processor configured a set of signals from said sensors and to activate or deactivate said solenoids, and l. a power system to power said solenoids, said sensor and said processor, whereby, the solenoids are activated when the sensors detect a person on a side of the door opposite to the side that is being pushed, and whereby the activation of the solenoids engages the first, or the second, or both springs with the horizontal link, increasing the damping force on the door and damping movement of the door.

2. The door closer control system of claim 1, wherein said second shaft is mounted at a predetermined distance from said first shaft to provide a torque transfer from the rotation of the first shaft to the second shaft.

3. The door closer control system of claim 1, wherein said first shaft is 6 inches long and is rotatably attached to said pinion of said door closer.

4. The door closer control system of claim 1, wherein said sensors are PIR sensors.

5. The door closer control system of claim 1, further having an alert system configured to indicate the presence of a person around the door.

6. The door closer control system of claim 5, wherein said alert system is a light or a sound system.

7. The door closer control system of claim 1, further having a wind sensor a sensor configured to detect wind speed.

8. The door closer control system of claim 1, wherein said power system is a set of rechargeable batteries.

9. The door closer control system of claim 1, wherein said system further has a set of rechargeable batteries, and a generator to recharge said rechargeable batteries, wherein said generator produces electricity from a movement of the door.

10. A door closer control system configured to attach to a door closer of a door, said door closer having a rack and a pinion mechanism, said door closer control system comprising:

a) a damping system attached to said pinion mechanism to damp the motion of said door closer;

b) a motion detection system to detect an existence of a person around said door and to active said damping system;

wherein the damping system comprises a shaft rotatably secured on said door and having a first end connected to said pinion mechanism; a horizontal support link provided on said shaft and having first and second apertures;

a first spring having a first end and a second end, wherein said first end of said first spring is secured to a housing of the door closer control system and a second end of said first spring is configured to engage to and disengage from the first aperture;

a second spring having a first end and a second end, wherein said first end of said second spring is secured to the housing and a second end of said second spring is configured to engage to and disengage from the second aperture;

wherein the motion detection system comprises a set of sensors mounted on opposite sides of said door to detect a presence of a person in an area around the door;

a set of solenoids configured to engage said first and second springs with said horizontal link when the set of sensors detect a person around said door, thereby damping motion of said door;

a processor configured to receive a set of signals from said sensors and to activate or deactivate said set of solenoids; and a power system to power said set of solenoids, said set of sensors, and said processor.

11. The door closer control system of claim 10, wherein said door is a vehicle door.

* * * * *